US006729406B1

(12) United States Patent
Collins et al.

(10) Patent No.: US 6,729,406 B1
(45) Date of Patent: May 4, 2004

(54) METHOD AND APPARATUS FOR PERFORMING CUTTING OPERATIONS IN A SUBTERRANEAN WELL

(75) Inventors: Dannie R. Collins, The Colony, TX (US); James M. Barker, Mansfield, TX (US); David J. Leidel, Arlington, TX (US); John A. Regalbuto, Fort Worth, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/378,520

(22) Filed: Aug. 20, 1999

Related U.S. Application Data

(63) Continuation of application No. 08/760,038, filed on Dec. 4, 1996, now abandoned.

(51) Int. Cl.[7] ..... E21B 43/116

(52) U.S. Cl. ..... 166/297; 166/382; 166/55.2

(58) Field of Search ..... 166/55, 117.6, 166/55.2, 297, 298, 382

(56) References Cited

U.S. PATENT DOCUMENTS

| | | | | |
|---|---|---|---|---|
| 2,407,093 A | | 9/1946 | Mohaupt | |
| 2,684,030 A | | 7/1954 | Muskat et al. | |
| 2,686,472 A | | 8/1954 | Burns | |
| 2,758,543 A | | 8/1956 | Grandin | |
| 2,935,020 A | | 5/1960 | Howard et al. | |
| 2,935,021 A | | 5/1960 | Niles | |
| 2,935,038 A | | 5/1960 | Chatten | |
| 3,034,178 A | | 5/1962 | Cartier et al. | |
| 3,057,295 A | | 10/1962 | Christopher | |
| 3,165,057 A | | 1/1965 | Armstrong | |
| 3,245,485 A | | 4/1966 | Bell | |
| 3,335,664 A | | 8/1967 | Enzian | |
| 4,116,130 A | | 9/1978 | Christopher et al. | |
| 4,151,798 A | | 5/1979 | Ridgeway | |
| 4,354,433 A | * | 10/1982 | Owen | 166/297 X |
| 5,325,924 A | | 7/1994 | Bangert et al. | |
| 5,467,824 A | * | 11/1995 | DeMarsh et al. | 166/297 |
| 5,525,010 A | * | 6/1996 | Kenny et al. | 166/55 X |
| 5,636,692 A | * | 6/1997 | Haugen | 166/298 |
| 5,709,265 A | * | 1/1998 | Haugen et al. | 166/117.6 |

* cited by examiner

*Primary Examiner*—Frank Tsay
(74) *Attorney, Agent, or Firm*—Halliburton Energy Services, Inc.

(57) ABSTRACT

Apparatus and associated methods of using the apparatus are disclosed for performing cuts in a subterranean well. The apparatus utilizes linear shaped charges arranged in an endless pattern which are used to cut a pattern in a downhole structure. The charges are discharged to perform the cutting operation.

51 Claims, 12 Drawing Sheets

METHOD AND APPARATUS FOR PERFORMING CUTTING OPERATIONS IN A SUBTERRANEAN WELL

This is a Continuation of application Ser. No. 08/760,038, filed Dec. 4, 1996 for METHOD AND APPARATUS FOR PERFORMING CUTTING OPERATIONS IN A SUBTERRANEAN WELL which is now abandoned.

TECHNICAL FIELD

The present invention relates to improvements in methods and apparatus for performing cuts in subterranean wells and, more particularly, to methods and apparatus for using linear focused explosives to form endless cuts in the confines of a subterranean well.

BACKGROUND OF THE INVENTION

From time to time it is necessary to perform machining functions at subsurface locations in subterranean wells. For example, if a window in a subterranean casing is desired to allow the drilling or formation of a branch bore, the typical process involves utilizing a whipstock with a milling or cutting tool to mill a window in the casing. If a downhole tool such as a whipstock, whipstock-packer assembly or the like blocks the bore of a subterranean well, typically an opening can be cut through the obstruction using a mill or drill. If an axial length of casing is to be removed to allow undercutting, an undercutting tool is lowered into the well to mill out the casing section and surrounding cement as desired.

The prior art methods and apparatus utilized to perform these subsurface operations are expensive because they are time consuming and involve sophisticated milling equipment.

SUMMARY OF THE INVENTION

The present invention contemplates improved methods and apparatuses for performing subsurface cutting operations in a subterranean well. The invention uses linear shaped charges and related methods to perform subsurface cutting and shaping. Linear shaped charges are devices which utilize focused explosive reactions to produce cuts along a line in hard materials. In other words, linear shaped charges are generally symmetrical about a line and make linear cuts.

The present invention utilizes linear shaped charges prearranged on an apparatus to form an endless pattern corresponding to the periphery of an opening to be formed. The linear shaped charges are lowered into the well to a location adjacent to the site of the proposed cut and discharged to cut through the wall of the tubing, casing, or other structure along the periphery of the opening to be formed. For example, when the casing is to be cut, an endless pattern of linear shaped charge is formed at the surface on an apparatus and carried downhole. When the charge is exploded, an endless cut around the opening in the casing is formed. The plug formed by the cut can be removed as a single piece or cut into smaller sections and removed or milled. In other applications downhole objects other than casing are cut, such as, whipstocks, packers, liners, and the like.

According to another aspect of the present invention, the apparatus can carry one or more patterns of linear charges so that cutting can be performed at two or more spaced points. Removal of the casing can be achieved conventionally or by sectioning the severed casing portions with linear shaped charge patterns extending between the two or more circumferential cuts. Thus, the present invention contemplates using linear shaped charges to sever or disconnect a section of casing and cut it into small pieces so that it can be removed from the well.

According to the present invention, a shaped window can be formed in the wall of tubing, such as the casing or liner of a subterranean well, by first arranging linear charges to form a pattern according to the desired shape, lowering the charges downhole on a carrier to a preselected location, and discharging the linear shaped charge pattern to cut the desired shaped plug or section from the wall of the well tubing. The cut plug can thereafter be removed by conventional fishing techniques or may be cut into smaller pieces by using linear shaped charges.

The present invention also contemplates the utilization of staged detonations of individual segments of the pattern to be cut. For example, the side or axially extending portions of a casing window could be cut in one or more steps and the circumferential, or top and bottom, portions of the window could be cut in separate steps with indexing of the charge carrier in the casing to insure intersection of the successive cuts. In this manner a plurality of linear shaped charges or segments could be arranged to form an endless pattern. The charges forming the segmented portions of the charge patterns could be separated on the carrier radially. In this case the carrier could be indexed in position and rotated between successive segment firings. The charges forming segments of the pattern could be axially spaced allowing the carrier to be progressively moved axially to perform the sequential detonations. The charge segments could be on one carrier or separate carriers. Similar methods and apparatus could be applied to cut other type of tubings, such as, liners and the like at a subsurface location.

According to another embodiment of the present invention, a whipstock or packer can be used to drill and complete a branch bore. For example, an opening can be formed in the whipstock by use of a linear shaped charge pattern either mounted in the whipstock itself or in a carrier subsequently placed adjacent to the whipstock. According to this embodiment, an opening is formed in the whipstock or packer by discharging a linear shaped charge arranged in an endless pattern to allow access through the whipstock or packer to the well located therebelow.

According to another aspect of the present invention, linear shaped charges can be used to form complicated shaped openings in the wall of a casing, including shapes such as bayonet slots, rectangles, and the like which cannot be formed by conventional milling techniques. The ability to form unique and complicated shaped windows in casings allows for locator and mechanical locking connections with the casing wall which have heretofore been impossible to form. These methods of forming special shaped openings can, of course, be used in other well structures besides casings.

BRIEF DESCRIPTION OF THE DRAWINGS

The accompanying drawings are incorporated into and form part of the specification that illustrate and describe several examples or embodiments of the present inventions. These drawings together with the description serve to explain the principles of the inventions. The drawings are to be used only for the purpose of illustrating the preferred and some of the alternative examples of how the inventions can be made and used and are not to be construed as limiting the invention to only the illustrated or described examples. The various advantages and features of the present invention will be apparent from a consideration of the drawings in which.

DETAILED DESCRIPTION

Figure 1:
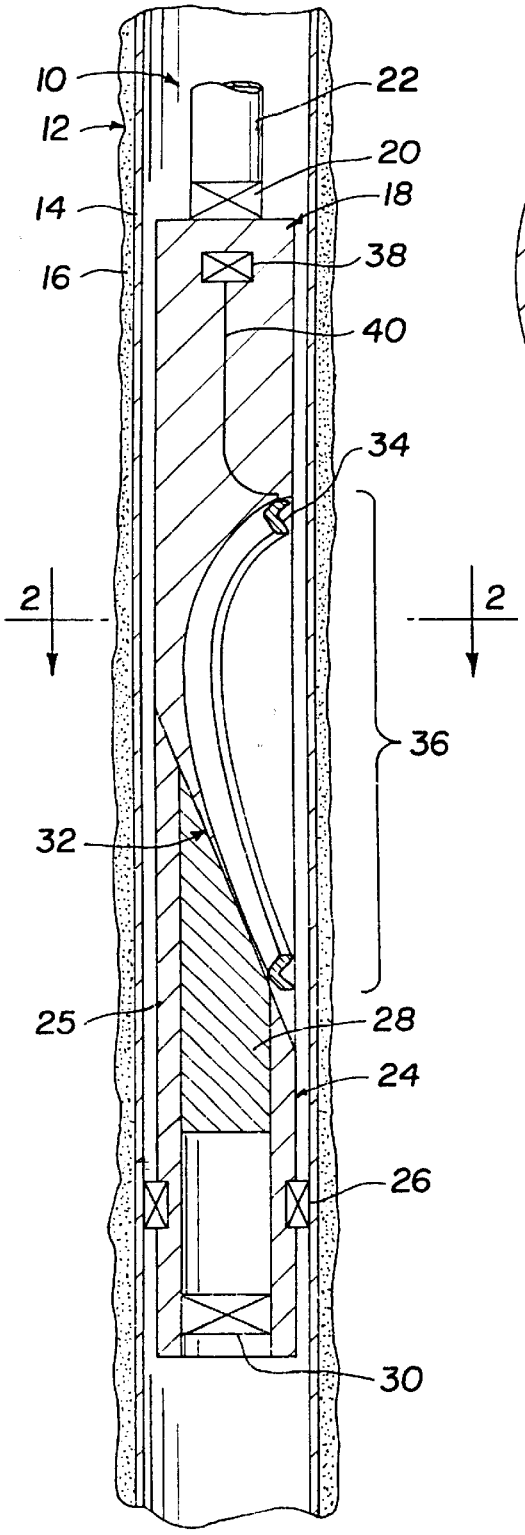
FIG. 1 is a cross sectional view through a subterranean well having a cased wellbore showing the linear shaped charge carrier of the present invention lowered into a position adjacent to the location where a window is to be formed and resting on the upper surface of a whipstock assembly.
Figure 2:
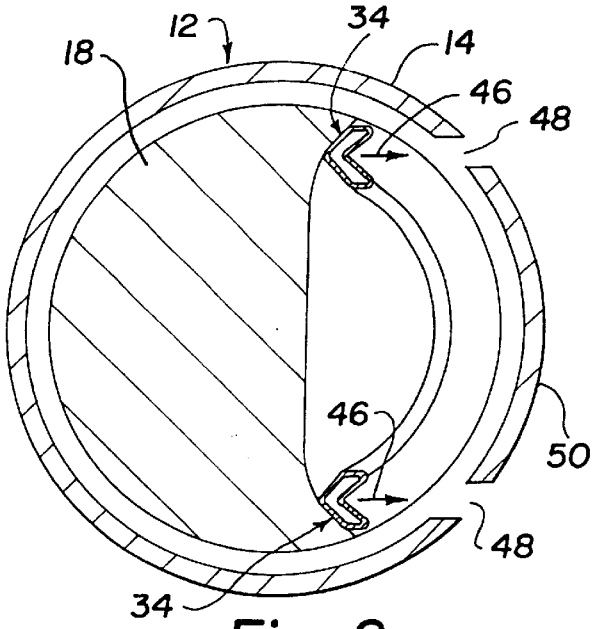
FIG. 2 is a cross sectional view taken on line 2—2 of FIG. 1 looking in the direction of the arrows.
Figure 3:
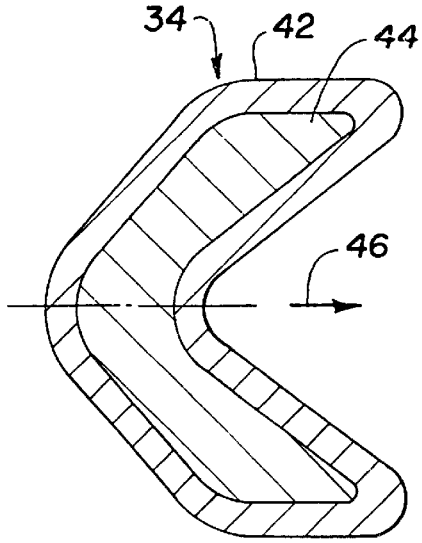
FIG. 3 is an enlarged cross sectional view of a typical linear shaped charge.

The present invention will be described by referring to the drawings of the apparatus and method steps showing various examples of how the invention can be made and used. In these drawings reference characters are used throughout the several views to indicate like or corresponding parts. In FIGS. 1–3 embodiments of the apparatus for use in performing subsurface operations in a subterranean well casing are shown. The methods of the present invention will be described in reference to the embodiments of FIGS. 1–3 and other embodiments shown or described herein. For purposes of description, the apparatus will be generally referred by reference numeral 10. Apparatus 10 is illustrated in position in a portion of a subterranean well 12. The section of subterranean well 12 is shown cased or lined 14 with the casing held in position by cement 16. It should be appreciated that the invention is not intended to be unduly limited by the drawing selected to illustrate the exemplary embodiments. For example, the invention has application to both cemented and uncemented casings, tubings inside of casings, liners, and any other subterranean well members. In addition, the portion of the subterranean well shown in the figures accompanying this application should not be construed as being directional, in that, the present invention has application whether or not aligned in a portion of a subterranean well, which is horizontal or vertically inclined and that it can be used in the main bore or any of the branches from the main bore.

In FIG. 1, apparatus 10 is shown in diagrammatic form with a carrier 18 connected through coupling 20 to a means 22 for manipulating the carrier 18 in the well 12. In FIG. 1 and the other exemplary figures, the manipulating means 22 is shown and identified generically as tubing; however, it is to be appreciated that carrier 18 could be manipulated into position in the subterranean well 12 by drill pipe, coiled tubing, cable, rod, pump down apparatus, or the like. When the terms tubing or manipulating means are used in this regard they are intended to include any means for positioning a device in a well.

Carrier 18 is shown having been positioned adjacent to a locator assembly 24. In this embodiment locator assembly 24 operates to properly position and directionally rotate the carrier. Although not essential to the present invention, the presence of some form of locator means provides substantial advantages. For illustration only, the locator 24 has been selected as a whipstock packer assembly so that it can be used to perform additional well processing steps. Locator 24 is a retrievable whipstock packer assembly, previously set in proper position and orientation to engage interior walls of the casing 14 to hold the assembly 24 in position. There are many well known methods and devices for properly locating and orientating devices in a well which could be used. A selectively operable setting or anchor means 26 is diagrammatically shown mounted on the body 25 of assembly 24. Anchor 26 has well known structure, not shown, to provide releasable engagement, and, just for example, such structure could be pressure actuatable. Assembly 24 has a drillable inner core 28 and removable plug 30. In the embodiment shown, locator assembly 24 and carrier 18 each have corresponding engaging wall surfaces 32 which can be used to locate the carrier 18 at the proper longitudinal position in the subterranean well 12 and in the proper radial orientation. In the embodiment shown, surfaces 32 are complimentary and inclined. However, these surfaces could be transverse or at right angles to the axis of the casing. These interengaging surfaces could be pins, sockets, grooves, slots, and other means well known in the art to orient, align, or relatively position the two pieces of equipment in a subterranean well.

Mounted on the carrier assembly 18 are one or more linear focused explosive charges 34 arranged in a pattern to cut an opening in window area 36 in the wall of casing 14. An actuator 38 is connected to charge 34 and is utilized to explode or discharge charge 34.

In the embodiment shown, the focused explosive charge 34 is a linear focused charge. A type of linear focused charge is shown in FIG. 3. A linear charge utilizes a lined cavity effect to produce cuts in hard metals and other materials. A dense inductive metal sheath 42 is formed in a selected cross sectional shape such as a chevron and contains a core of densely consolidated high explosive 44. When the core 44 is initiated or discharged, the extreme pressure from the reacting explosives drives opposite sides of the metal sheath toward a plane 46 of the charge. The materials arriving from opposite walls of the sheath 42 collide to form an elongated cutting jet of sheath materials which propagates in the direction of arrow 46. This jet can be used to cut through hard metal or other materials. Linear shaped charges can be used to form cuts along a straight or curved line as contrasted to hollow-cavity-focused explosives which are symmetrical about an axis of revolution and are used to form holes. Linear shaped charges can be formed in or shaped in a two or three dimensional patterns by deforming the metal sheath before inserting the core of explosive materials. When linear shaped charges are curved, the cut formed by the jet is likewise curved. Linear shaped charges are initiated or exploded by use of a cap or firing head in a process well known in the industry. Suitable linear shaped charges are supplied by Accurate Arms Company, Inc., P. O. Box 167, McEwen, Tenn. 37101.

In FIG. 1 charge 34 has been arranged in a endless pattern which conforms to the periphery of the opening to be formed in area 36 in casing 14. In the embodiment shown, the charge 34 is in an elliptical pattern to form an elliptical opening in a casing to access a branch borehole. An endless pattern is used to cut around and substantially remove a shape from the surrounding material. If, for example, a circular endless shaped pattern is used, a circular shape or plug will be cut from the surrounding material.

The term endless pattern is not intended to suggest or imply that the linear charge or charges making up the pattern are themselves necessarily endless. Of course, one linear charge arranged in an endless pattern is included. It is also intended to mean that one or more linear shaped charges could be arranged with ends substantially adjacent, intersecting, or overlapping to form at least one substantially continuous endless cut pattern.

In the embodiment of FIG. 1 locator assembly 24 is initially set in position in the subterranean well adjacent to the proposed site of the window 36. In a manner well known in the industry, the physical location and directional orientation of the locator 34 are manipulated as desired prior to fixing or setting the locator 24 in position. Next, the carrier 18 is positioned in the well with the surfaces 32 orientating the carrier and properly positioning it for later operations.

The presence of locator assembly 24 is unnecessary for practicing the present invention; however, it provides an advantage in properly locating window 36 and it provides a surface for later use when a branch borehole is to be drilled through the opening 36. In other words, the carrier assembly 18 could be properly positioned and oriented in manners well known in the oil industry without the use of the locator assembly 24. For example, the assembly 24 could be installed after the window 36 has been formed in accordance by the teaching of the present inventions.

Once carrier 18 is positioned within the well, the exploding or discharging step can occur. This is accomplished in this embodiment shown by moving a weight or rod through the manipulating means 22 and coupling 20 to engage the actuator 38 to discharge the cap and explosive charge 34. The discharging step can be accomplished by pressure changes, acoustic energy, electromagnetic energy, motion sensors, and any other means well known in the industry.

As is shown in FIG. 2, the cutting force of charge 34 is focused in the direction of arrow 46 to form a cut 48 in the wall of casing 14. With this charge pattern plug 50 is cut out of the wall 14. Preferably, in situations where the material being cut is cemented in place, the focused linear explosive charge 34 would, likewise, sever and disturb the surrounding cement 16 to allow the removal of the plug 50 from the well.

It is preferable that the cross sectional dimensions of the plug 50 be selected to be less than the internal diameter of the casing 14 from which the plug has been cut. This is accomplished by the step of arranging the focused explosive charge 34 in a pattern to achieve this result. Once the discharging step has been completed, the carrier assembly 18 and plug 50 can be removed and further operations performed in the subterranean well.

Figure 4:
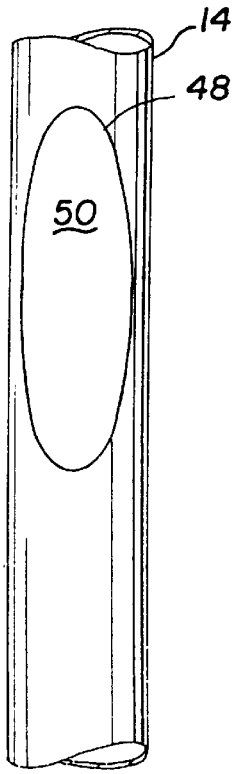
FIG. 4 illustrates a subterranean well casing with the window pattern in an oval shape formed in accordance with the method and apparatus of the present invention.
Figure 5:
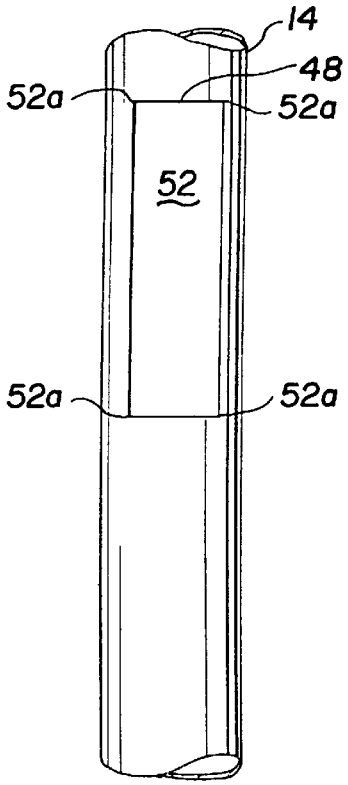
FIG. 5 illustrates a subterranean well casing with the window pattern in a rectangular shape formed in accordance with the method and apparatus of the present invention.
Figure 6:
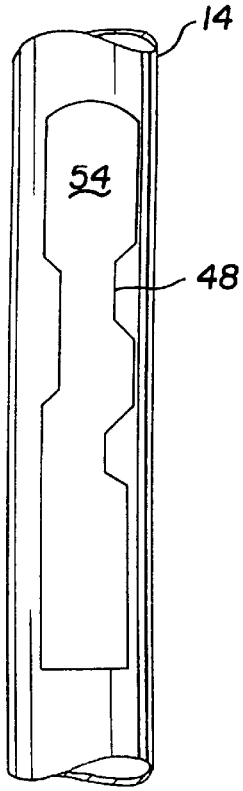
FIG. 6 illustrates a subterranean well casing with the window pattern in an example of an irregular complicated shape formed in accordance with the method and apparatus of the present invention.

In FIGS. 1 and 2 the explosives have been arranged in a pattern corresponding to an elliptical opening desirable for use in forming a branch bore therethrough. However, an unlimited variety of other shaped plugs could be cut. In FIG. 4 an elliptical shaped cut 48 in the casing 14 is shown forming a generally elliptical shape plug 50. In the same manner a circular plug (not shown) could be cut. In FIG. 5 a rectangular shape plug 52 is shown formed by a cut 48 in the casing 14. Rectangular plug 52 has sides intersecting at corners 52*a*. In the method utilized to form the rectangular plug 52, the focused explosive charge 34 is arranged on the carrier 18 to correspond to the periphery of the plug 52. When the carrier with charges arranged in a rectangular pattern are positioned in the subterranean well and discharged cuts 48 will define a rectangular pattern. As previously pointed out, the pattern of FIG. 5 could be cut by more than one linear explosive charge. For example, four separate charges could be arranged end to end (or intersecting or overlapping at the corners 54*a*). In FIG. 6 an irregular shaped plug 54 is shown formed by cuts 48, demonstrating the flexibility of the shapes and patterns which can be cut in the casing 14 by arranging the focused explosive charges 34 as desired. It should appreciated that the combination of arcs, straight, and curved lines intersecting and interacting with each other to form unlimited shapes, such as circles, quadrilaterals, triangles, slots, keyways, and the like.

Figure 7A:
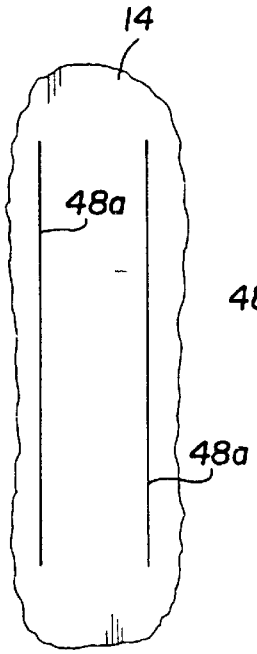
FIGS. 7*a* and 7*b* illustrate an embodiment of the sequential cutting steps performed in accordance with the present invention.
Figure 7B:
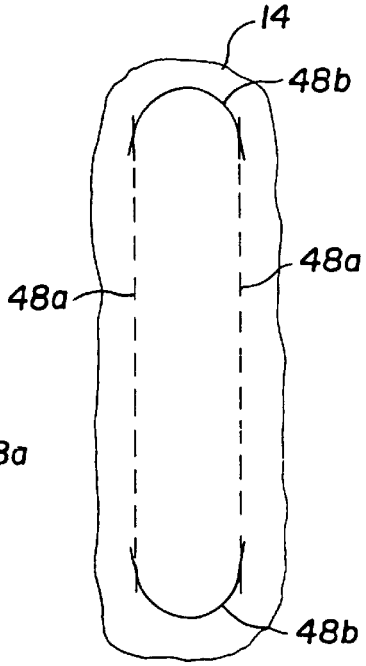

In FIGS. 7*a* and 7*b* one method of the present invention will be described in which an endless pattern is cut in steps by sequential discharging of focused explosive charges. In FIG. 7*a* one step of the sequence firing method is illustrated. In this step the focused explosive charges 34 have been arranged in two parallel extending lines to form two parallel cuts 48*a*. Another step is illustrated in FIG. 7*b*. The initial cuts 48*a* are shown in dotted lines. In this second step arched or curved cuts 48*b* are made by prearranging the charges in a pattern of two spaced arches 48*b* which are shown in FIG. 7*b* in solid lines. It is to be appreciated that cuts 48*a* and cuts 48*b* intersect and overlap (as shown) to form an endless pattern of an elongated slot shaped cut in the casing 14. Although only two sequential steps are shown in FIGS. 7*a* and 7*b* more than two sequential steps could be utilized depending on the size and shape of the pattern to be cut in the casing 14. The cuts from sequential firings could be formed using a single carrier with a delay between sequential firing. The delay could be timed in milliseconds, seconds, minutes, or hours apart with or without movement of the carrier between firings. Also, more than one carrier could be utilized in the sequential firing. For example, a carrier could contain the charges which form one or more of the cuts 48*a* and separate carriers moved into the position to form the cuts 48*b*.

Figure 8A:
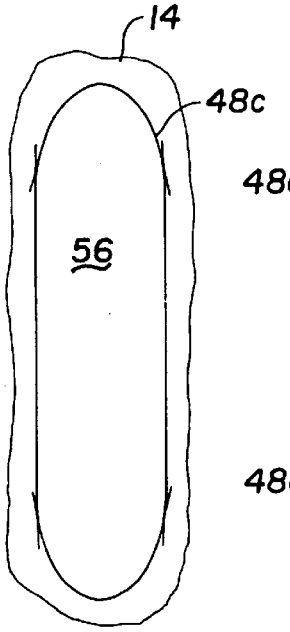
FIGS. 8*a* and 8*b* illustrate a second embodiment of the sequential cutting step performed in accordance with the present invention.
Figure 8B:
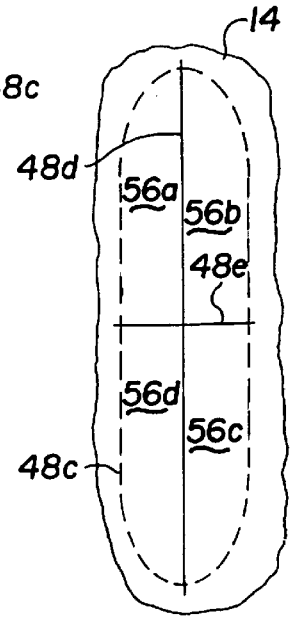

In FIGS. 8*a* and 8*b* an embodiment of the sequential firing method of the present invention is shown. In this embodiment one or more charges are arranged in an overlapping pattern 48*c* and are discharged to cut along the entire periphery of elongate window to form plug 56. In another step or steps, charges are arranged in an endless pattern along lines 48*d* and 48*e* to intersect or overlap pattern 48*c*. Charge patterns 48*d* and 48*e* are discharged to quarter the plug 56 into sections 56*a*–56*d*. For purposes of illustration, plug 56 is shown cut into four pieces; however, the plug could be cut into any number of pieces by arranging charge patterns as desired. The order of the sequential cutting is not believed to be critical, in that, the cuts 48*d* and 48*e* could be performed before the cut 48*c* or simultaneously with cuts 48*c*. The methods of FIGS. 8*a* and 8*b* could be performed in a single step to cut the periphery around a plug and simultaneously sever it into smaller pieces to facilitate removal.

Figure 9A:
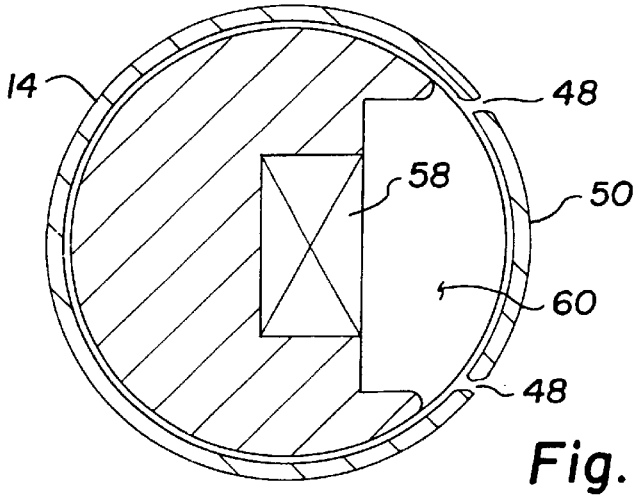
FIGS. 9*a, b,* and *c* are cross sectional views of a subterranean well casing showing various methods and apparatus for removing the casing plug formed by cutting a peripheral window in the casing in accordance with the present invention.
Figure 9B:
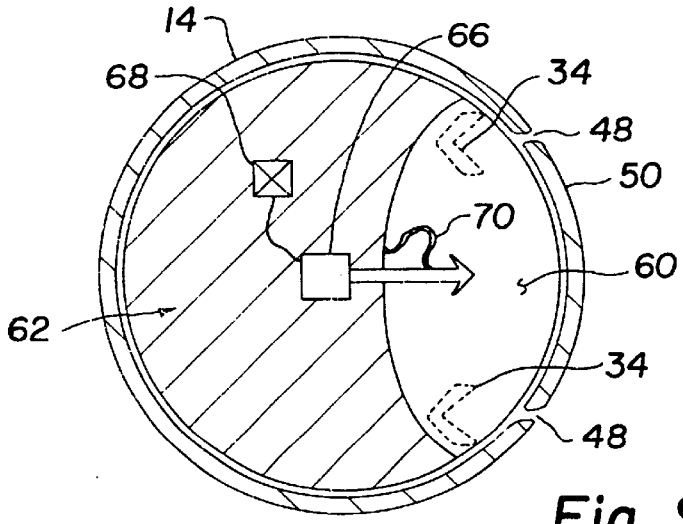
Figure 9C:
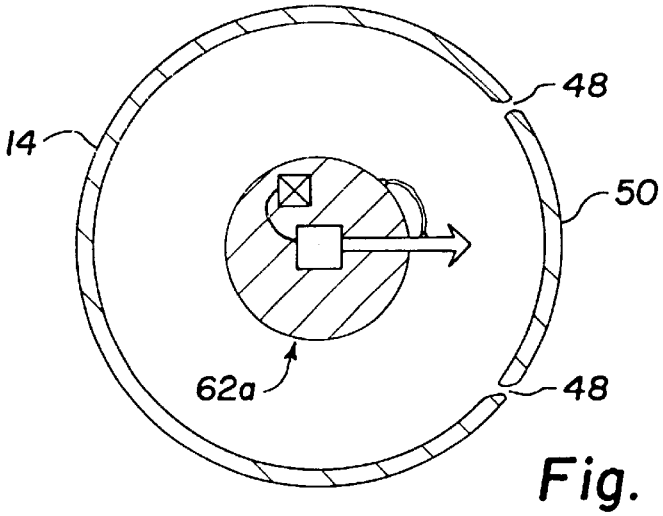

In FIGS. 9*a* through 9*c* various apparatus and methods of removing plug 50 are shown. In FIG. 9*a* plug 50 is fished from the well by use of a magnetic fishing tool 58 lowered to a position adjacent to the steel plug 50. In operation, the magnetic fishing tool 58 is lowered to a position adjacent to the plug 50 and the magnetic forces pull the plug 50 into a pocket in recess 60 formed in the fishing tool. It is to be appreciated that the magnet could be incorporated in the carrier 18 to allow simultaneous cutting and removal.

In FIG. 9*b* an alternate embodiment for recovering the plug 50 is shown. In this embodiment the carrier 18 additionally comprises a harpoon assembly 62. The harpoon assembly 62 consists of a harpoon 64 which can be propelled through the plug 50 for retrieval. The harpoon 64 is propelled by charge 66, which is in turn actuated by assembly 68 in a manner well known in the industry. It is to be appreciated that the harpoon 64 is tethered at 70 to assist in pulling the plug 50 into the recess 60. The harpoon can be propelled either before or after focused explosive charges 34 have been discharged.

In FIG. 9*c* an alternative embodiment of the harpoon assembly is shown as 62*a*. In this embodiment the harpoon assembly is separate from the carrier and is positioned adjacent to plug 50 for retrieval after the cuts 48 have been formed. The embodiments of FIGS. 9*b* and 9*c* have special applications in cases where the plug 50 is nonferrous.

Figure 10:
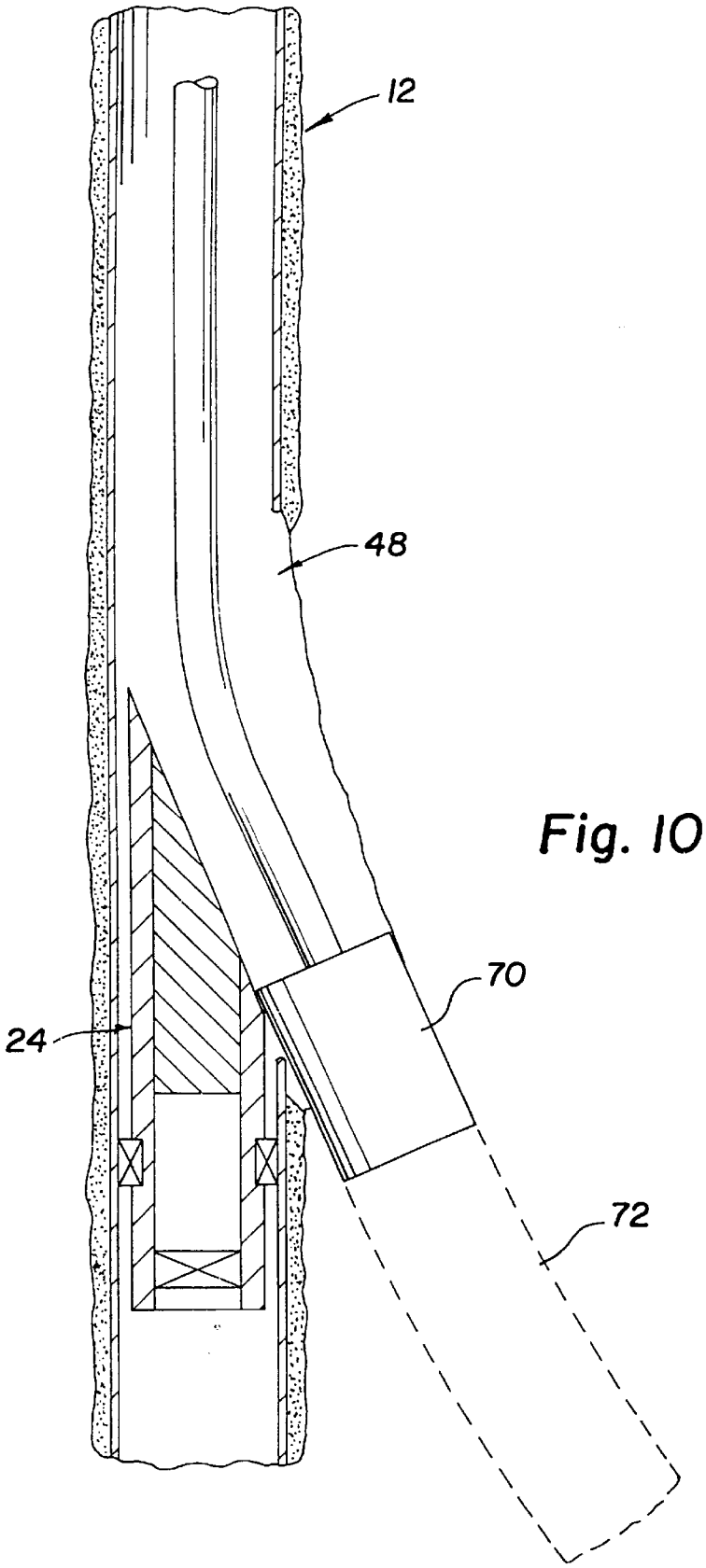
FIG. 10 illustrates initial milling off of a whipstock assembly for forming a branching borehole through a window formed in accordance with the method and apparatus of the present invention.

FIG. 10 illustrates an optional step which can be used when the method described with regard to FIG. 1 is used to form a branch borehole opening. In FIG. 10 carrier 18 and plug 48 have been removed. Locator assembly 24 in the form of a retrieval whipstock-packer assembly is set in position. A mill 70 can be used, if necessary, with the whipstock assembly to smooth out or mill the edges formed by the cuts 48 and thereafter, drill a branching drainhole 72 in a manner well known in the industry. Alternatively, mill 70 could be used to remove plug 48 as it proceeds to drill downhole 72.

Figure 10A:
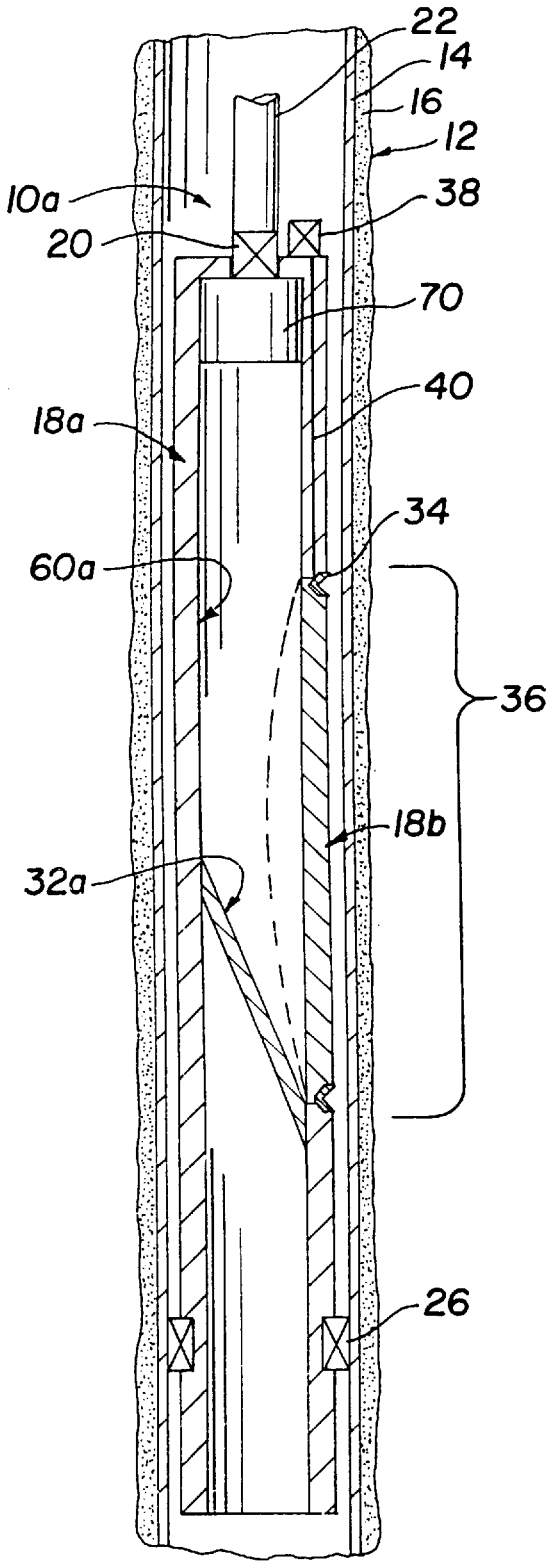
FIG. 10*a* is a cross sectional view similar to FIG. 10 of an alternative embodiment in accordance with the methods and apparatus of the present invention.

In FIG. 10*a* apparatus 10*a* includes a carrier 18*a* in the form of a ring neck whipstock. A linear charge pattern 34 is arranged on carrier 18*a* to surround window 36. Charge 34 is connected at 40 to charge actuator 38. Setting means 26 are engaged to hold carrier 18*a* in position in casing 14 of well 12. Carrier 18*a* has internal deflector surface 32*a* extending across a cylindrical cavity 60*a* in carrier 18*a*. Mill 70 is located in cavity 60*a* and is connected by coupling 20 to manipulating means 30 (shown as drill tubing).

After carrier 10*a* is fixed in position by setting means 26, charge pattern 34 is discharged to form window 36 in casing 14. Means 22 is used to operate mill 70 to remove drillable wall 18*b* from carrier 18*a* and the plug formed in window 36. Surface 32*a* guides mill 70 in this operation and in subsequent operations of drilling a branching borehole (not shown) as described in reference to FIG. 10. Using the apparatus 10*a*, a window and branching borehole can be formed in a single downhole trip.

Figure 11:
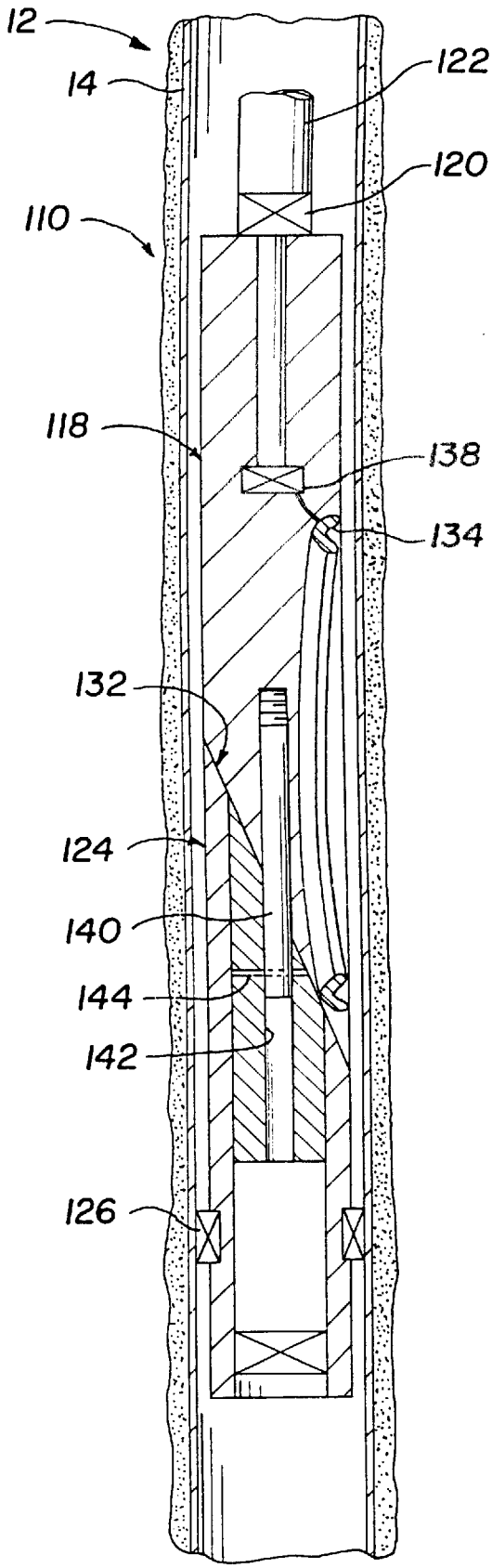
FIG. 11 illustrates an alternative embodiment of the linear shaped charge carrier of the present invention in which the carrier is initially assembled with a packer-whipstock assembly.

In FIG. 11 a variation of the carrier locator assembly is illustrated. In this embodiment apparatus 110 comprises a carrier assembly 118 releasably connected to locator assembly 124. Apparatus 110 is run into the well 12 as a unit or assembly. Once in place the locator assembly 124 is set with anchor 126 engaging the wall of the casing 14. After the cutting steps are performed according to the methods described herein using linear charges 134 and actuator 138, the carrier assembly 118 can be separated from locator assembly 124. As is shown the carrier 118 and locator 124 are connected by a tube 140 fixed to extend from carrier 118 into an axial bore 142 formed in locator assembly 124. A shear pin assembly 144 releasably connects rod 140 in bore 142. In this embodiment the ramp or incline of the surfaces 132 will, when the charges 134 are discharged, shear the pin 144 separating the carrier 118 from the locator 124. However, should pin 144 fail to completely shear, separation and removal of carrier 118 can be accomplished by upward or rotary forces applied from the surface to the carrier 118 through means 122, in a manner well known in the industry. Thereafter, the locator assembly 124 (illustrated in the form of a whipstock) can be utilized to drill a branching borehole through the window formed in the casing.

Figure 12:
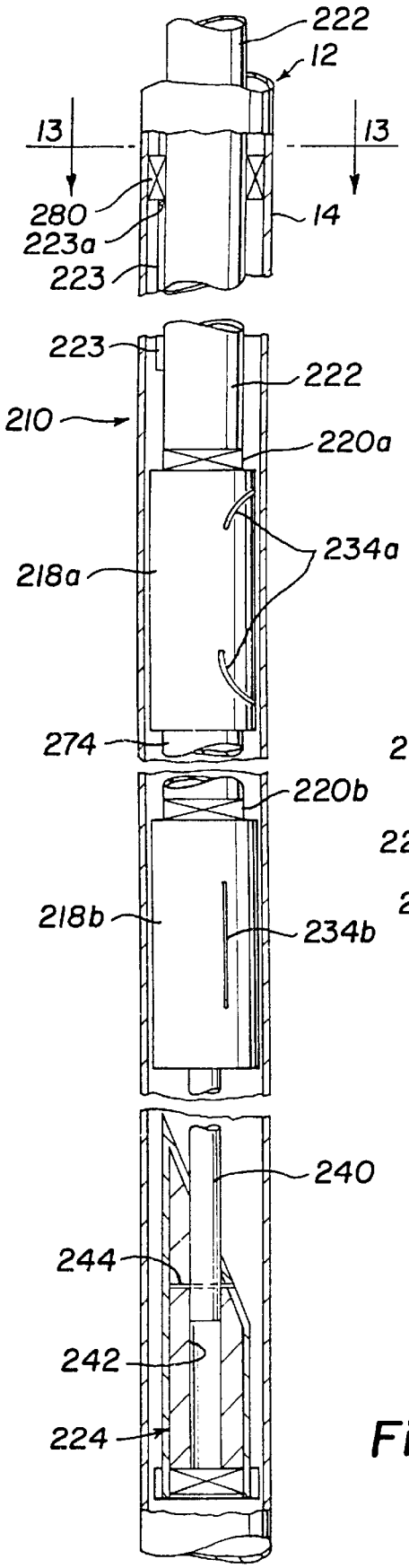
FIG. 12 illustrates an alternative embodiment of the linear shaped charge carrier of the present invention in which charge segments are axially spaced for sequentially positioning and detonation.
Figure 13:
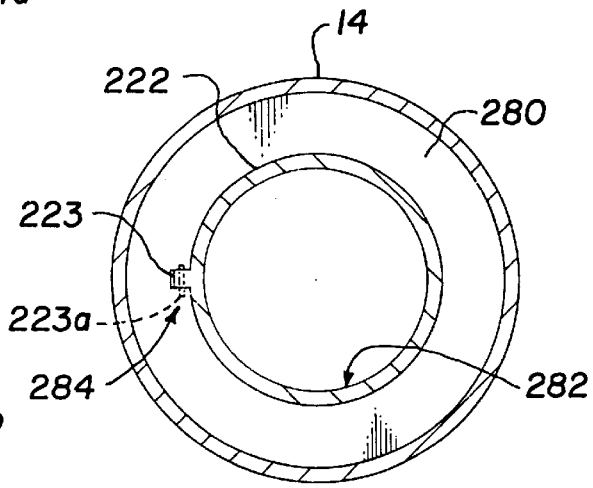
FIG. 13 is a sectional view taken on lines 13—13 of FIG. 12 looking in the direction of the arrows.

In FIGS. 12 and 13 an embodiment of the apparatus 210 for performing the methods of the present invention is shown. In this embodiment the apparatus 210 comprises a manipulator in the form of tubing 222 having a longitudinally extending key 223 formed in the outer surface thereof. Tubing 222 and key 223 form a portion of the carrier assembly 218. A first carrier portion 218*a* is connected to tubing 222 by connector 220*a*. Tubing 274 connects carrier portion 218*a* to a second carrier portion 218*b*. The two carrier portions 218*a* and 218*b* can be axially spaced as desired by selecting lengths of the tubing 274. Alternatively, carriers 218*a* and 218*b* could be a single elongated piece carrying both charges 234*a* and 234*b*, eliminating the need for tubing 274.

Optionally, a locator assembly 224 can be included in apparatus 210 either above or below the carrier assembly 218. The FIG. 12 embodiment illustrates the locator assembly 224 attached below carrier 218 by tubing 240. Similar to the structure previously described with regard to FIG. 11, tubing 240 is releasably attached in bore 242 by shear pin 244. As shown the locator assembly 224 is in the unengaged or unset position.

The apparatus 210 also includes a remotely setable packer assembly 280. Packer assembly 280 has a internal bore of a size to receive in axial sliding engagement tube 222 therein. Bore 282 has a groove 284 of a size to receive key 223 therein. The interengaging surfaces on groove 284 and key 223 prevent relative axial rotation between the packer assembly 280 and the tube 222. Shear pins 223*a* can be provided in key 223 (shown) or in tube 222 (not shown) to engage parker 280 to temporarily limit relative axial movement between tube 222 and packer 280.

According to the method of the present invention, the packer assembly 280 is first set at the proper location and orientation with the shaped linear charges 234*a* and 234*b* on the carriers 218*a* and 218*b* respectively facing in the proper direction for cutting a window. According to the method of embodiment of FIGS. 12 and 13, carrier 218*a* is actuated to discharge the shaped charge pattern 234*a* and make initial cuts in the casing 12. Thereafter, tubing 222 is moved axially by shearing pin 223*a* to position the carrier 218 corresponding to the cuts formed in the casing 214 by the carrier 218*a*. Thereafter, carrier 218*b* is actuated to discharge the linear shaped charge pattern 234*b*. In this embodiment the shaped charges 234*a* and 234*b* are arranged in the pattern shown in FIGS. 7*a* and 7*b* to form an elongated window in the casing 14. Other patterns shown and described in regard to FIGS. 4–8 could be used. In addition patterns 234*a* and 234*b* could themselves be endless patterns forming axially spaced windows or could be indexed and moved to perform sequential independent filling of the same patterns in the same location. If, for example, more than two sequential steps are required, additional carrier portions could be axially spaced in the apparatus 210 to perform the additional steps.

Once the window has been formed, tubing 222 is moved upward to shear another pin 223*a* to place the locator assembly 224 adjacent to the window. Alternatively, if the locator assembly 224 is attached above carrier assembly 218 tubing 222 would be moved downward to a position adjacent the window. The locator and is initiated in a manner well known in the industry to set the locator 224 adjacent to the window. Thereafter, the tubing 240 can be severed from the assembly 224 by an upward force shearing pin 244. The packer assembly 280 is disengaged and the entire assembly 210 removed from the well leaving the locator assembly 224 in proper position for guiding operations through the window formed in the casing 14. If assembly 224 is above the assembly 218, removal of tubing 222 would leave assembly 218 in the well supported from below locator assembly 224. If no locator is present in apparatus 210, the steps of setting and separating locator are eliminated.

It is also anticipated that one or more of the retrieval method steps such described with regard to FIGS. 9*a*, 9*b*, and 9*c* could be utilized to remove the plug cut from the wall casing 14. In this regard fishing apparatus (not shown) could be included in apparatus 210 either above or below locator 224. A combination of the embodiments shown in FIGS. 11 and 12 could be utilized with a single stage firing by placing the locator assembly axially spaced from the carrier as shown in FIG. 12 to be set after the casing 14 has been cut.

Alternately, the carriers 218*a* and 218*b* could have charge patterns which each cut a complete window, such as illustrated in FIGS. 4–6. When these charges on carriers 218*a* and 218*b* were initiated, two separate windows could be formed on a single downhole trip.

Figure 14:
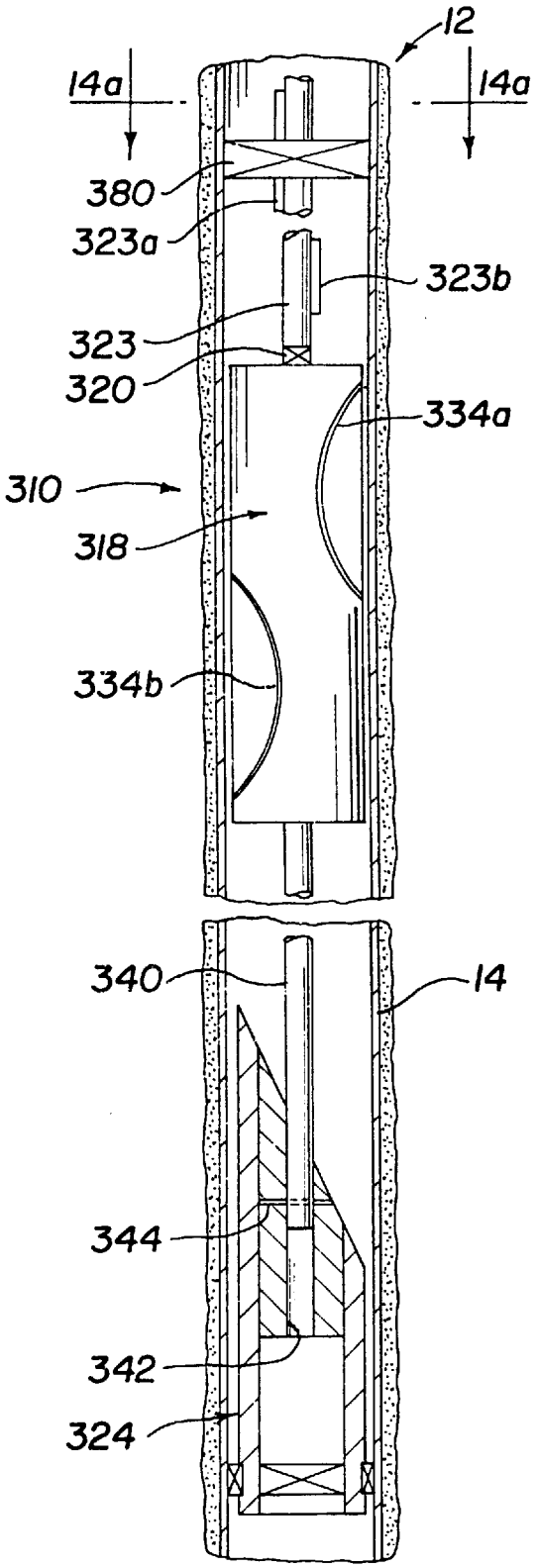
FIG. 14 illustrates an alternative embodiment of the present invention in which the linear shaped charge carrier assembly is rotated radially to perform sequential detonation steps.
Figure 14A:
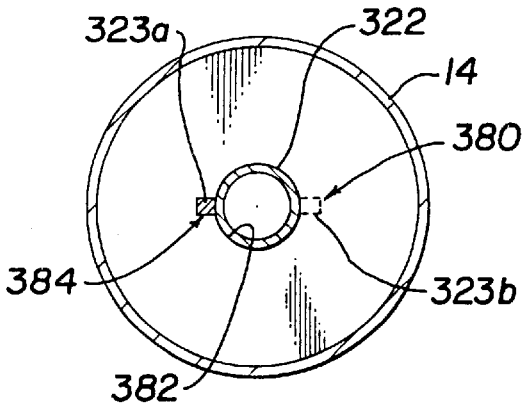
FIG. 14*a* is a sectional view taken on lines 14*a*—14*a* of FIG. 14 looking in the direction of the arrows.

In FIGS. 14 and 14*a* an embodiment of the carrier assembly for practicing the methods of the present invention is shown. In the apparatus 310 illustrated in FIGS. 14 and 14*a*, a carrier 318 has two linear focused explosive charge patterns 334*a* and 334*b* in spaced positions on the carrier. As illustrated the charge patterns are displaced from each other both radially and axially.

In accordance of the methods of this apparatus the charges 334*a* and 334*b* are fired in stages and means are provided for indexing and positioning the charges properly between the firing stages to result in a continuous or endless cut pattern. In this embodiment a packer assembly 380 is run and set above the desired location. Packer 380 has a bore 382 and indexing groove 384. Tube 323 is of the size to axially slide in bore 382. Tubing 323 has a pair of diametrically opposed keys 323*a* and 323*b* which extend axially along the tube. As in the previous embodiment, shear pins (not shown) could be installed to provide axial location of the tube 323 in packer 380. Key 323*a* is positioned to properly orient focused explosive charge pattern 334*a* while key 323*b* is subsequently located to properly align charge pattern 334*b*. Optionally a tube 340 could connect a locator assembly 324 at a axially spaced position from carrier 310. Locator 324 is releasably connected through bore 342 and shear pin 344 to tube 340.

In operation, the packer assembly 380 is set with the groove 384 in a proper axial orientation. Key 323 and shear pins position charge pattern 334*a* for initiation. After charge 334*a* is discharged the pins are sheared and tube 322 is raised and rotated until key 323*b* is in slot 384 to properly orient charge pattern 334*b* for discharge. In this manner patterns of charges 334*a* and 334*b* can be radially spaced and properly indexed, such that when discharged cut an endless pattern in casing 14.

Although in FIGS. 14 and 14*a* two charge patterns are shown axially and radially spaced, it is to be appreciated that carrier 210 could be assembled with two or more radially spaced charge patterns or a combination of radially and axially spaced patterns could be utilized to sequentially discharge any number of charge patterns to perform the process of the present invention and form a continuous or endless cut.

Figure 15:
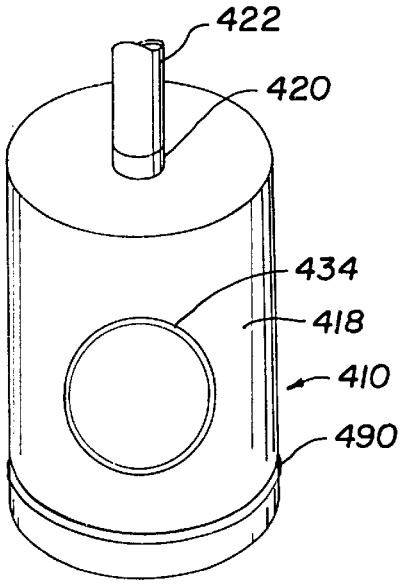
FIG. 15 is an alternative embodiment of a linear shaped charge carrier for use in forming a shaped window for a lateral borehole.

In FIG. 15 apparatus 410 is shown. In a manner well known in the industry carrier 418 can have a set of releasable slips 490 which can be utilized to lock the carrier in place in the casing at the desired location before initiation of the focused explosive charges 434. When slips 490 are not present of carrier 418, the setting step would be eliminated. Carrier 418 is releasably connected at 420 to tubing 422. Tubing 422 is utilized to manipulate the carrier 418 in a subterranean well. Carrier 418 has a prearranged pattern of linear focused explosive charges 434, which in this embodiment show a generally circular in form. The charges 434 are provided with an actuator (not shown) similar to that shown and described with regard to FIG. 1.

Figure 16:
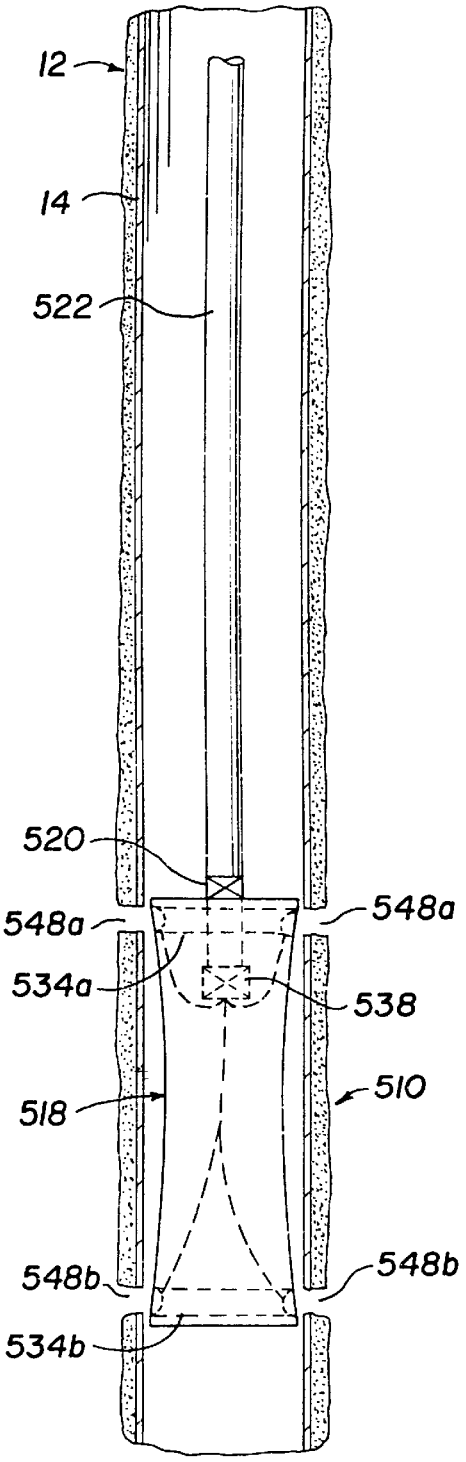
FIG. 16 illustrates an alternative embodiment of the present invention used to remove an axial section of casing.

FIG. 16 illustrates an apparatus 510 utilized in the method of the present invention to cut a tubular section in a subterranean well. The tubular section is illustrated as casing 14 of well 12. The apparatus utilized to perform this method comprises carrier 518. Carrier 518 is provided with at least two axially spaced circularly arranged patterns of charges 534*a* and 534*b*. Carrier 518 is manipulated in the well and held in position by tubing 522 through connection 520. An actuator 538 is mounted inside the carrier 518 and is connected to the linear shaped charge patterns 534*a* and 534*b* for simultaneous or staged discharge. Two independently operable actuators could be present to allow sequential detonation of the patterns. It is to be appreciated that the linear shaped charge 534*a* is located on the periphery of the carrier 518 and forms a continuous circular pattern therearound. The size of the carrier 518 closely approximates the interior wall of the casing 14 so that when the shaped charge 534*a* is detonated the casing will be severed along cut 548*a*. In a similar manner charge pattern 534*b* forms a circular cut 548*b* in casing 14 adjacent to the charge pattern 534*b*.

In practicing the method of the present invention the apparatus 510 is first assembled at the surface and the charges 548*a* and 548*b* are arranged in a circular pattern to perform the desired cuts to be made in the subterranean well. The patterns are placed on the carrier 518. The axial spacing determines the axial length of tubing to be cut. The carrier 518 is lowered into position and discharged whereupon the shaped charges 534*a* and 534*b* make circumferential cuts 548*a* and 548*b* respectively in the casing 14 thus removing an axial length of casing. It is to be appreciated that the circumferential cuts can be performed in sequence with one of the cuts being performed first and, thereafter, the carrier 518 axially moved to locate the second cut. In the alternative, a second carrier is positioned in the well to form the second cut. In this manner long axial lengths of tubing could be cut using shorter axial length carriers.

Figure 17:
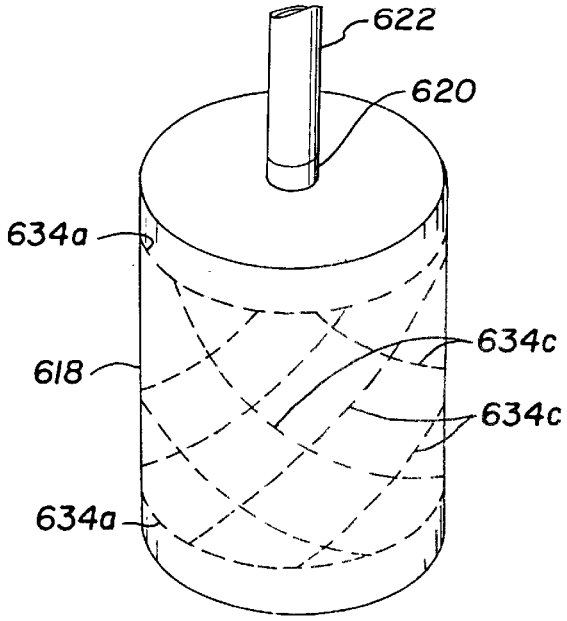
FIG. 17 illustrates an alternative embodiment of a linear charge carrier used to perform the methods of the present invention.

In FIG. 17 a variation of the apparatus of in FIG. 16 is shown. In carrier 618 upper and lower circumferentially arranged charge pattern 634*a* and 634*b* respectively are present for use in severing the tubing in the subterranean well. In addition, a plurality of intersecting linear charge patterns 634*c* are present to form generally diamond shaped pattern of cuts which form a plurality of small pieces for removal from the well. The diamond shaped patterns are for illustration of any number of patterns which could be used to allow removal. For example, one alternative pattern would involve making a plurality of axially extending cuts to quarter or otherwise section the casing piece for removal.

Figure 18:
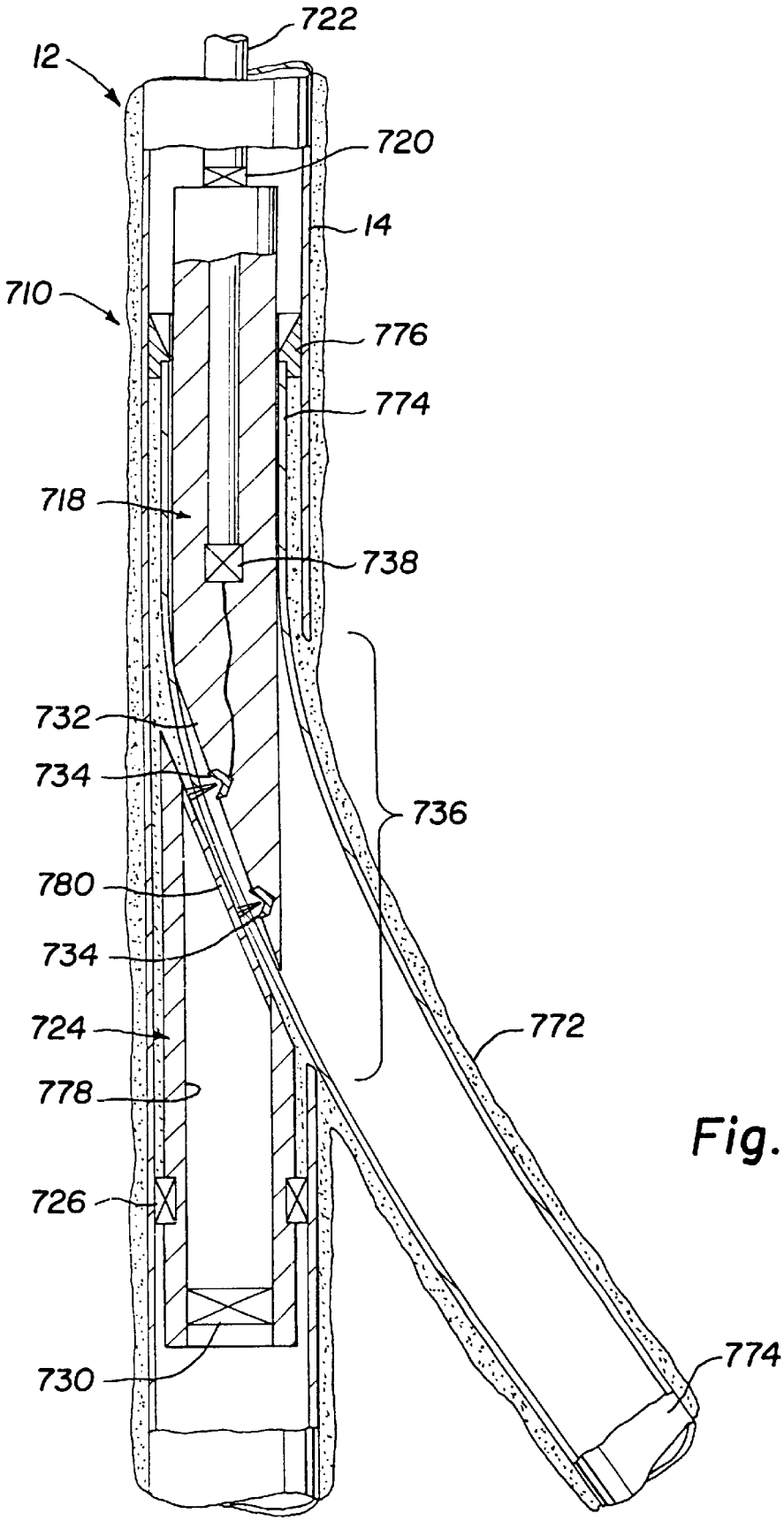
FIG. 18 is an alternative embodiment in which a carrier is used to cut a window in the wall of the liner and the whipstock after the liner has been installed.

In FIG. 18 an apparatus and related methods of the present invention are utilized to reopen a primary bore after a branch borehole liner has been installed. Casing 14 of the subterranean well 12 has a window 736 formed in the wall thereof. This window 736 can be formed in accordance with the methods and apparatus disclosed herein or in a conventional manner by milling. Branching borehole 772 has been drilled and liner 774 has been installed. Liner 774 is terminated at a packer 776 in casing 14 at a position axially spaced from the opening 736. Locator assembly 724 in the form of a packer whipstock has been set in casing 14. The packer whipstock assembly 724 has a bore 778 which is plugged at its lower end at 730. The upper end of bore 778 is closed by wall 780.

In accordance with the method of the present invention apparatus 710 comprises a carrier 718 designed to cut a window in the wall 780 to reopen casing 14 through the interior bore 778 of the whipstock assembly 724. In the embodiment shown, the carrier has an inclined face 732 which is selected to correspond to inclination of liner 774 and wall 780. Carrier 718 is shown positioned in subterranean well 12 by means of tubing 722 through connection 720. Prior to placing carrier 718 in the well, linear shaped charge 734 is arranged on the surface 732 in a continuous pattern (not shown). Charge 734 is focused in a direction so that when discharged an opening will be cut in the wall of liner 774 corresponding to the pattern in which charge 734 is arranged. In addition, charges 734 will cut through wall 780 of locator 724. In this manner, when plug 730 is removed, casing 14 is reopened through locator 724. Optionally, these cuts in the liner 774 and wall 780 could be milled smooth after they are formed.

Figure 19:
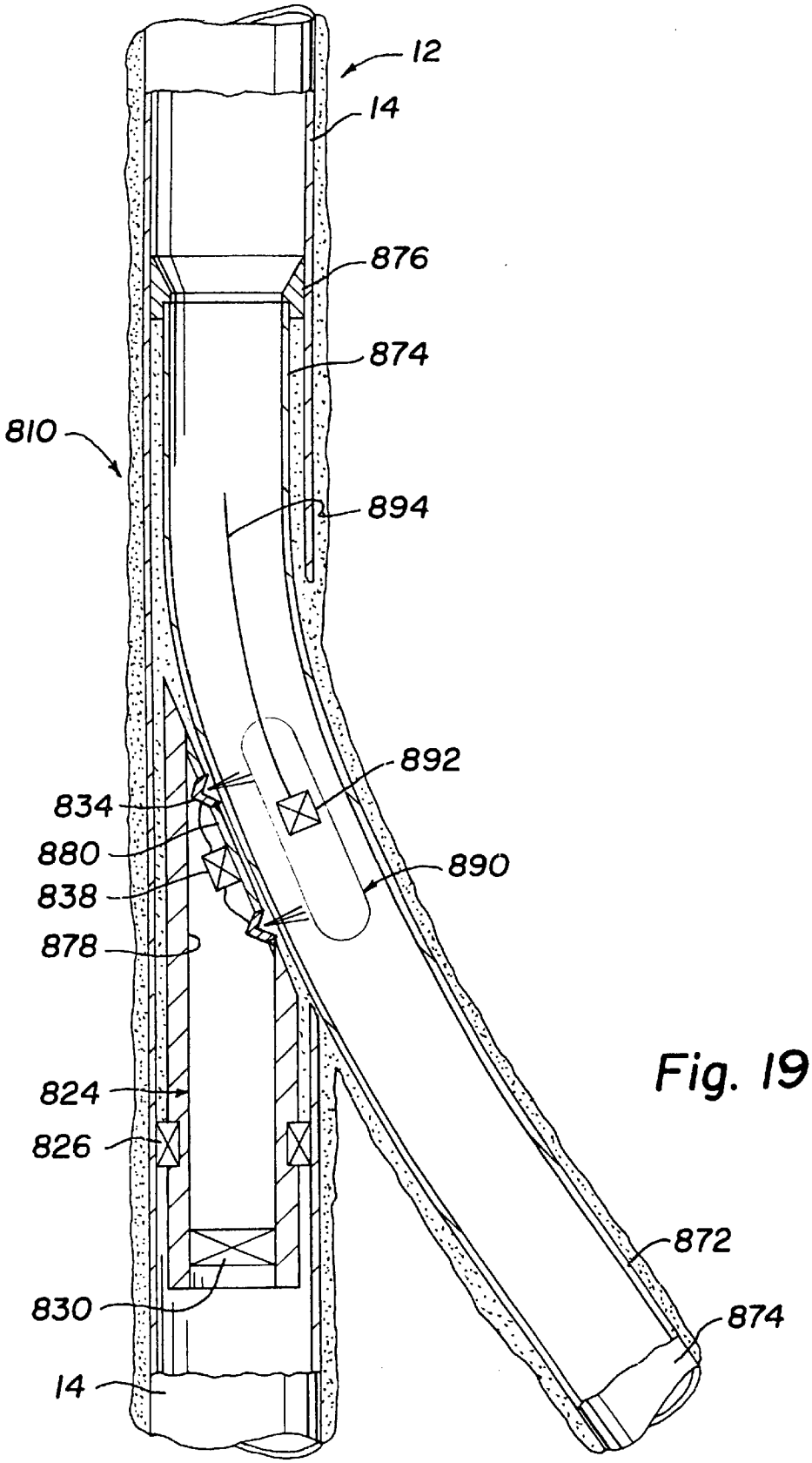
FIG. 19 illustrates a whipstock formed in accordance with the present invention containing linear shaped charge which can be activated to cut a window in the whipstock and the wall of the liner subsequent to the liner's installation.

In FIG. 19 an apparatus 810 and method of reopening casing 12 through the wall of a branch borehole liner is disclosed. In this embodiment the carrier is a special locator assembly 824 in the form of a whipstock packer which has been set in casing 12 by setting means 816. As was the case in FIG. 18 the liner 874 in borehole 872 is terminated in casing 12 by packer 876. Assembly 826 has linear charge 834 arranged in a pattern to form an opening. The linear charges 834 are focused to not only cut through the wall 880 in assembly 824 but also to cut through the wall of liner 874. In this manner an opening is formed between the bore 878 in the whipstock assembly 824 and tubing 874. The actuator 838 utilized to discharge the linear charge 834 can be actuated by tool 890. In this embodiment tool 890 contains a transmitter 892 which is capable of producing a predetermined signal. Actuator 838 contains a corresponding receiver which is present to recognize the predetermined signal emitted by transmitter 892. In addition, actuator 838 contains a time delay which can be set to delay the discharge of charges 834. In operation, tool 890 is positioned as shown by wire line 894 or the like. The transmitter 892 sends the predetermined signal which is received and recognized by actuator 838. Actuator 838 starts the time delay to allow removal of tool 890 before the charges 834 are discharged. After the bore has been reopened, milling could be used to smooth the edges of the cuts.

Figure 20:
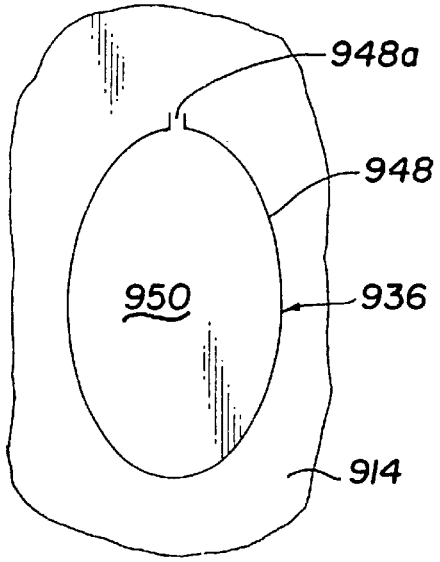
FIGS. 20–22 illustrate cutting patterns formed in accordance with the methods and apparatus of present inventions.

FIG. 20 illustrates a cut pattern 948 formed in a well using linear shaped charges in accordance with the present inventions. In this embodiment, cut pattern 948 is endless, in that, except for tab 948*a*, cut pattern 948 substantially surrounds or borders the plug 950 cut in wall 914. Tab 948*a* is used to maintain plug 950 in place and in later steps can be cut or broken to remove plug 950. In environments where clearance is present behind plug 950, the window 936 can be opened by bending tab 948*a* to move plug 950 out of the plane of wall 914.

Figure 21:
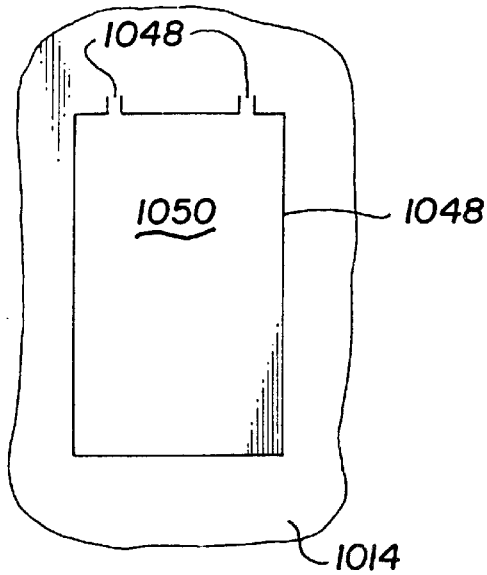

FIG. 21 illustrates a cut pattern 1048 formed in a wall 1014 of a well using linear shaped charges in accordance with the present inventions. Like FIG. 20, cut pattern 1048 is substantially endless, in that, two tabs 1048*a* are formed on the edge of plug 1050. The tabs are illustrated in FIGS. 20 and 21 on the up hole side of the plug, however it is envisioned that tabs could be located on the sides or bottom (downhole) side. Also, the plug could be bent inward to form a deflecting surface or to enhance removal.

Figure 22:
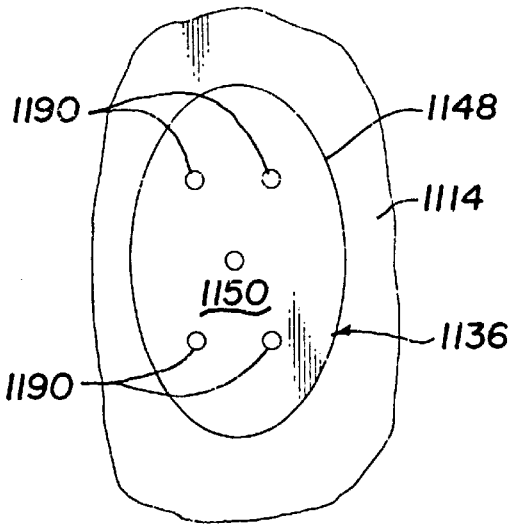

In FIG. 22 cut pattern 1148 is oval shaped and surrounds plug 1150 in wall 1114. In environments where removal or disturbance of materials behind plug 1150 is desired, this embodiment utilizes point focused charges to form one or more holes or opening 1190 in wall 1114. For example, when wall 1114 has been cemented in place, forming holes 1190 by point focused explosives penetrates the material behind plug 1150 and breaks up the cement bonds enhancing removal of plug 1150. Using point focused explosives in this manner also breaks up or disturbs the formation present behind plug 1150 enhancing drilling of a secondary borehole through opening 1136. As an additional step, holes 1190 can be used as a port or passageway to remove formation material. Holes 1190 can be used as a passageway to jet drill or dissolve the formations located adjacent plug 1150 thus allowing plug to be moved into the space formed thereby. When the steps of forming holes 1290 and formation removal are used in patterns such as illustrated in FIGS. 20 and 21, the plugs 950 and 1050 can be pivoted or bent outward about tabs 948*a* and 1048*a* into the spaced formed by jet drilling.

The foregoing disclosure and description of the invention are illustrative and exemplary thereof, and various changes in the size, shape, materials, as well as the details and combinations of the illustrated constructions can be made without departing from the spirit and scope of the invention as defined in the appended claims.

What is claimed is:

1. A method of forming an opening in a subterranean well tubing comprising: arranging focused explosive charges on a carrier by placing focused linear explosives in at least two separately dischargeable patterns in spaced locations on the carrier;

positioning the carrier in a well adjacent to the site of the opening to be formed; and discharging the focused explosive charges to cut through the wall of the tubing around the opening to be formed and wherein the discharging step comprises discharging one of the patterns adjacent the opening to be formed and thereafter moving the carrier and thereafter discharging a second of the patterns adjacent the opening to be formed.

2. The method of claim 1 wherein the arranging step further comprises arranging the focused explosives in a pattern corresponding to the periphery of the opening to be formed and wherein the discharging step further comprises cutting the tubing around the entire periphery of the opening to be formed.

3. The method of claim 1 wherein the arranging step comprises forming linear focused explosives in a line around at least a portion of the periphery of the opening.

4. The method of claim 3 additionally comprising the steps of discharging the focused explosives around the periphery of the opening to form a central plug bounded by the periphery and removing the plug from the well.

5. The method of claim 4 additionally comprising the step of arranging linear focused explosives in a pattern to extend across the plug and intersect the periphery thereof and thereafter discharging the focused explosives to section the plug whereby ease of removal from the well is improved.

6. The method of claim 1, wherein the steps of arranging, positioning, and discharging are repeated in steps to cut through the tubing completely around the periphery of the opening to be formed.

7. The method of claim 1 wherein the arranging step comprises placing a first pattern in a position on the carrier and placing the second pattern at an axially spaced position on the carrier.

8. The method of claim 1 wherein the arranging step further comprises arranging the first pattern in a position on the carrier and arranging the second pattern in an radially placed position on the carrier.

9. The method of claim 1 wherein the discharging step additionally comprises indexing the carrier in a first position wherein the pattern is aligned with the opening to be formed in the well tubing and thereafter discharging the first pattern and additionally comprising the step of indexing the carrier in a second position wherein the second pattern is adjacent to the opening to be formed and overlaps the cuts formed by the first pattern and thereafter discharging the second pattern to complete the formation of the opening in the tubing.

10. The method of claim 1 additionally comprising the step of setting a whipstock assembly adjacent to the location of the opening in the subterranean well and wherein the positioning step comprises engaging the carrier with the whipstock assembly to position the carrier in the well adjacent the opening to be formed in the tubing.

11. The method of claim 7 additionally comprising the step of releasably connecting the carrier to a whipstock assembly and wherein the positioning step comprises positioning the carrier and whipstock assembly adjacent to the opening to be formed and thereafter setting the whipstock assembly.

12. The method of claim 11 wherein the whipstock assembly is set prior to the discharging step.

13. The method of claim 11 wherein the whipstock assembly is set after the discharging step.

14. The method of claim 1 wherein the arranging step comprises arranging the explosive charges in a pattern which when discharged will form a subterranean opening in the tubing.

15. The method of claim 1 wherein the arranging step comprises arranging the explosive charges in a pattern which when discharged will form an elliptical opening in the tubing.

16. The method of claim 1 wherein the opening to be formed has at least a portion of the periphery which comprises a straight line portion.

17. The method of claim 1 additionally comprising the step of milling the opening formed after the discharging step.

18. The method of claim 1 wherein the well tubing comprises casing.

19. The method of claim 1 wherein the cutting of the well tubing comprises cutting downhole liner.

20. The method of claim 10 additionally comprising the steps of arranging in a carrier linear focused explosive charges in a pattern of a second opening to be formed in the whipstock assembly, positioning the carrier in the well adjacent the whipstock assembly and discharging the focused explosive charge to cut an opening in the whipstock assembly.

21. The method of claim 1 wherein said arranging step comprises arranging said charges in a circular pattern.

22. The method of claim 1 wherein said arranging step comprises arranging said charges in a elliptical pattern.

23. The method of claim 1 wherein said arranging step comprises arranging said charges in a polygonal pattern.

24. The method of claim 1 wherein said arranging step comprises arranging said charges in a irregular shaped pattern.

25. A subterranean well tubing having an opening formed in accordance with the process of claim 1.

26. A method of forming an opening in a subterranean well tubing comprising:

arranging in a carrier one or more linear focused explosive charges in a pattern corresponding to at least a portion of the periphery of the opening to be formed, positioning the carrier in a well adjacent to the site of the opening to be formed, discharging the focused explosive charges to cut through the wall of the tubing around at least a portion of the opening to be formed, and cutting a hole through the wall of said well tubing in said opening.

27. The method of claim 26 additionally comprising the step of removing material from outside said tubing through said hole.

28. A method of severing tubing in a subterranean well comprising:

arranging one or more linear focused explosive charges on a carrier in two or more patterns which corresponds to two or more spaced circumferential patterns, positioning the carrier in the well adjacent top the site for cutting the tubing, and discharging the focused explosive charges to form spaced circumferential cuts in the tubing to cut out an axial length of tubing.

29. The method of claim 28 additionally comprising the step of arranging linear focused explosive charges in an axially extending pattern, positioning the axially extending charges adjacent the cut out axial length of tubing and discharging the axially extending pattern to cut the axial length of tubing into sections.

30. A subterranean well tubing having an opening formed in accordance with the method of claim 28.

31. An apparatus for use in cutting the periphery of an opening in the wall in a subterranean well comprising:

a carrier assembly comprising at least one carrier;

at least two linear focused explosive charges mounted in spaced locations on the carrier assembly and each charge arranged on the carrier assembly in a pattern corresponding to at least a portion of the periphery of the opening; and a separate explosive charge initiator connected to each of the linear focused explosive charges whereby when the charges are detonated the wall in the well is cut in an endless pattern by the explosive charges to form an opening.

32. The apparatus according to claim 31, wherein the endless pattern is circular.

33. The apparatus according to claim 31, wherein the endless pattern is elliptical.

34. The apparatus according to claim 31, wherein the endless pattern is polygonal.

35. The apparatus according to claim 31, wherein the endless pattern is irregular shaped.

36. The apparatus according to claim 31, wherein the endless pattern has a shape, whereby the linear charge is capable of forming the opening having a shape which corresponds to the shape of the pattern.

37. The apparatus according to claim 31, further comprising a locator operably attached to the carrier assembly.

38. The apparatus of claim 31 wherein the linear focused explosive charges are mounted in locations on the carrier assembly which are axially spaced.

39. The apparatus of claim 31 wherein the linear focused explosive charges are mounted in locations on the carrier assembly which are radially spaced.

40. The apparatus of claim 31 wherein the linear focused explosive charges are mounted in locations on the carrier assembly which are both axially and radially spaced.

41. Apparatus for forming an opening from a first wellbore to a second wellbore, the first wellbore having an intersecting portion thereof which intersects the second wellbore, the first wellbore being lined with a tubular liner, the first wellbore liner extending at least partially axially within the second wellbore, and the first wellbore liner having an intersecting portion thereof which extends laterally across the second wellbore proximate the intersecting portion of the first wellbore, the apparatus comprising:

a whipstock mounted in the wellbore and positioned adjacent to intersecting portion of the liner; and a linear shaped charge arranged on the whipstock in an endless pattern whereby when said charge is exploded an opening corresponding to the shape of said pattern is formed in the wall of said liner.

42. The apparatus of claim 41 wherein said pattern is elliptical shaped.

43. The apparatus of claim 41 wherein said pattern is circular shaped.

44. The apparatus of claim 41 wherein said pattern is polygonal shaped.

45. The apparatus of claim 41 wherein said pattern is irregular shaped.

46. A method of forming an opening through the wall of a tubular structure extending laterally across a wellbore to thereby provide access to the wellbore, the method comprising the steps of:

providing a carrier having a cutting device disposed thereon, the cutting device comprising a linear shaped charge arranged in an endless pattern;

positioning the carrier within the wellbore, wherein the linear shaped charge is directed toward the wall of the tubular structure proximate the location where the tubular structure laterally extends across the wellbore;

activating the cutting device; and cutting into the wall of the tubular structure proximate the location where the tubular structure laterally extends across the wellbore.

47. The method of claim 46 additionally comprising the step of arranging the linear shaped charge in an elliptical pattern to cut an elliptical opening.

48. The method of claim 46 additionally comprising the step of arranging the linear shaped charge in a circular pattern to cut an elliptical opening.

49. The method of claim 46 additionally comprising the step of arranging the linear shaped charge in a polygonal pattern to cut a polygonal shaped opening.

50. The method of claim 46 additionally comprising the step of arranging the linear shaped charge in a irregular pattern to cut an irregular shaped opening.

51. A subterranean well tubing having an opening formed in accordance with the method of claim 46.

* * * * *